United States Patent [19]

Downing

[11] 4,184,383

[45] Jan. 22, 1980

[54] DUAL STROKE DRIVE MECHANISM FOR PUMPS

[75] Inventor: Harvey T. Downing, Huntsville, Ala.

[73] Assignee: Rohm and Haas Company, Philadelphia, Pa.

[21] Appl. No.: 884,523

[22] Filed: Mar. 8, 1978

[51] Int. Cl.[2] ..... G05G 1/00

[52] U.S. Cl. ..... 74/571 R; 74/40; 92/13.7

[58] Field of Search ..... 74/40, 570, 571 R, 571 L, 74/571 M, 828, 835, 836; 92/13, 13.4, 13.7; 222/309

[56] References Cited

U.S. PATENT DOCUMENTS

| | | | |
|---|---|---|---|
| 1,524,519 | 1/1925 | Joncha | 222/309 X |
| 1,990,184 | 2/1935 | Greenwald | 74/571 L |
| 2,583,864 | 1/1952 | Malmsten | 74/571 R |
| 2,807,213 | 9/1957 | Rosen | 92/13.7 X |
| 3,312,170 | 4/1967 | Brailsford | 92/13.7 X |

FOREIGN PATENT DOCUMENTS

| | | | |
|---|---|---|---|
| 1239538 | 4/1967 | Fed. Rep. of Germany | 92/13.7 |
| 1027307 | 2/1953 | France | 92/13.7 |

*Primary Examiner*—Lawrence J. Staab
*Attorney, Agent, or Firm*—Terence P. Strobaugh; George W. F. Simmons

[57] ABSTRACT

The present invention is concerned with a dual stroke drive mechanism of any size for a reciprocating device, such as a piston of a pump. It is particularly concerned with such a driving mechanism having means for selecting a particular stroke-length. It is more specifically concerned with a drive mechanism capable of imparting either one of two set stroke-lengths and means for selecting one of the stroke lengths before, or at certain intervals during, operation of the mechanism. The drive mechanism converts rotary movement of an input member into reciprocating rectilinear movement of an output member which may be connected to a piston and reciprocates the latter. A preferred application is in the field of sampling pumps for distributing liquid samples of small sizes into vials for analysis.

8 Claims, 3 Drawing Figures

DUAL STROKE DRIVE MECHANISM FOR PUMPS

BACKGROUND OF THE INVENTION

It is known that various mechanisms have been used for reciprocating a piston of a pump. Variable stroke-length or amplitude has also been provided in prior drive mechanisms for this purpose, as shown in U.S. Pat. Nos. 3,614,896 and 3,706,233. In these mechanisms, however, the change in stroke-length is rather complicated. To greatly lengthen or shorten the stroke required extended adjustment through a range of intermediate positions as by manual turning of a knurled adjusting knob (for example Item 65 in U.S. Pat. No. 3,614,896) or of a suitable key (for example fitting slot 426 and pin 427 of the embodiment of FIG. 7 in U.S. Pat. No. 3,706,233). Also, in these earlier systems, the piston start position changed with each change of stroke-length. The change from one stroke to another much different in length, whether shorter or longer than the first, practically required discarding th liquid pumped during the transition or providing a special receiving vessel to catch such liquid, unless the drive mechanism is stopped, that is, rendered inoperative, during the adjustment in stroke-length.

DESCRIPTION OF THE INVENTION

It is an object of this invention to provide a drive mechanism of comparatively simple construction to reciprocate an output member (that may be connected to a pump piston or the like to impart reciprocatory motion thereto), which mechanism incorporates means for selectively operating in one or the other of two modes, each serving to impart markedly different stroke-lengths. It is also an object to provide means for directly and rapidly shifting from an operation according to one mode providing a predetermined stroke-length to an operation according to the other mode having a substantially different predetermined stroke-length whereby the output member, in being shifted from one stroke-length to the second disparate stroke-length is not operated at intermediate stroke-lengths. Preferably, means is provided for effecting the shifting operation at the end position of the output member that is common to the stroke-lengths and corresponds to the position of the pump piston at the compltion of the forcing or discharge stroke. This is the same position of the piston in the pump chamber regardless of which stroke-length mode is in operation. Since the piston does not move during stroke selection when in this position, the fluid within the pump is not disturbed.

Other objects and the advantages of the present invention will be apparent in the following description and drawing.

The accompanying drawing is illustrative of an embodiment that represents the best present mode of carrying out the invention.

Generally, the dual stroke drive mechanism of the present invention comprises eccentric means having a yoke connected to an output member, crank means for driving the eccentric means in two modes to reciprocate the output member through two common paths each having a different stroke length, said crank means having a crank shaft and a crank arm extension secured to the crank shaft, stroke-length controlling means arranged to engage the yoke for driving the eccentric means in one mode or to engage the crank arm extension for driving the eccentric means in the other mode having a different stroke-length and means for selectively engaging the stroke-length controlling means with the yoke and with the crank arm extension respectively.

Figure 3:
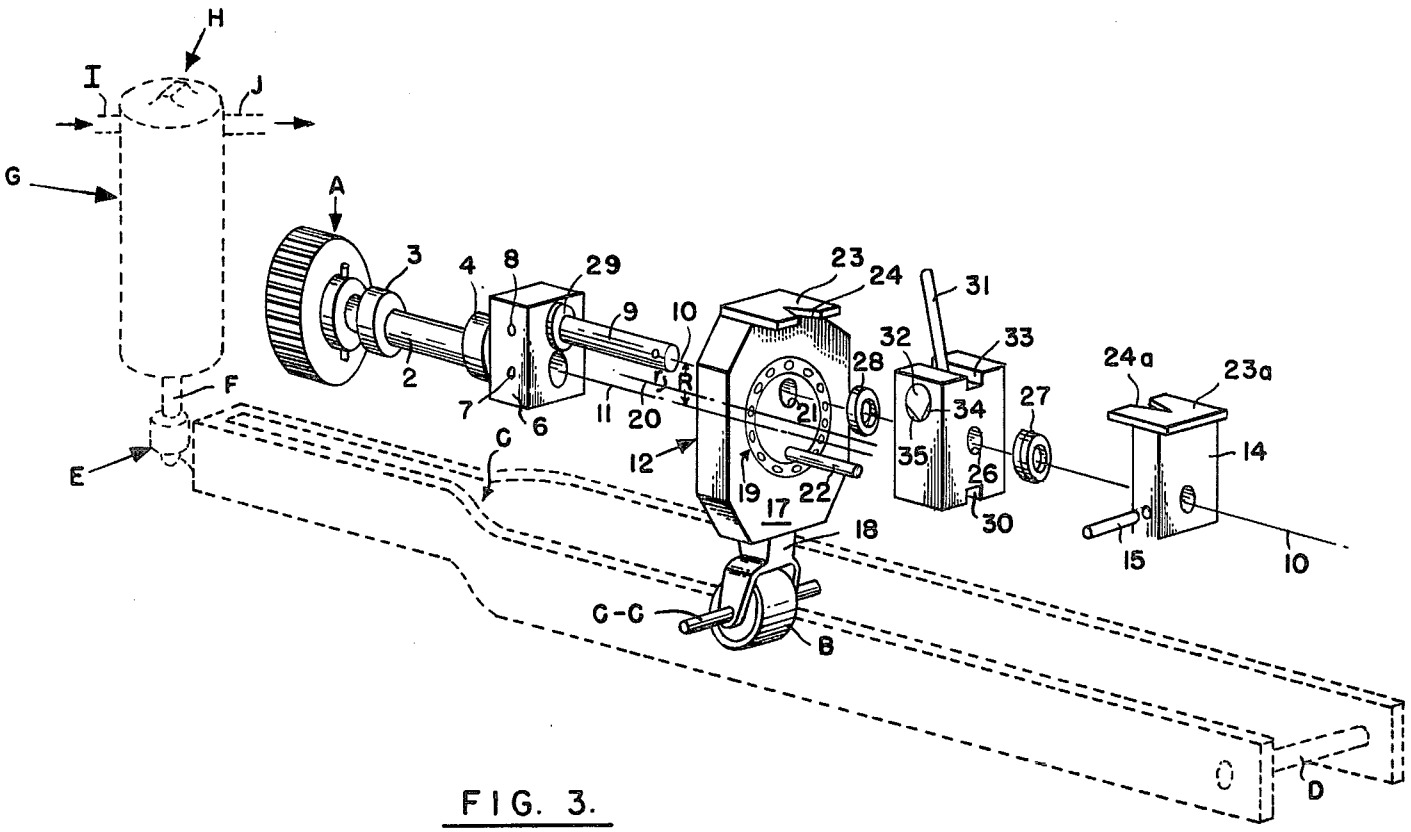
FIG. 3 is an exploded schematic view of the mechanism shown in FIG. 1 in relation to a piston pump.

In the embodiment shown in the drawing, the drive mechanism comprises an input member in the form of rotary gear A fixed to a drive shaft 2 mounted rotably in suitable bearings 3 and 4 within a support 5 which may take the form of a housing for part or all of the mechanism. The drive mechanism operated by rotation of input member A on the axis of shaft 2 serves to impart reciprocating motion to output member B in an up and down (vertical) direction as viewed in FIG. 1. The motion of this output member B may be imparted to the piston rod of any pump of the type in which the piston is reciprocated within a cylinder that is prevented from reciprocation with the piston. For example, as shown in FIG. 3 in phantom outlines, the motion of output member B swings a lever C about a pivot D having an axis that is stationary. The other end of lever C has a fitting E forming a universal joint with piston rod F, for example, a ball and socket joint, which reciprocates the piston rod F within a pump cylinder within the pump housing G which is supported at H, for example, by a universal joint, that allows slight swinging of G but prevents reciprocation of the pump cylinder with the pump rod F. The pump may be provided with an inlet I and an outlet conduit J connected to one end of the pump chamber or cylinder by suitable valve means (not shown) such as check valves, to control the flow in or out or both in relationship to the piston strokes, such valve means being known and not part of the invention. The lever C receives motion from member B by a transverse pin C—C extending through a swivel joint with B to fixed positions on the adjacent inside faces of the compound lever elements.

Figure 2:
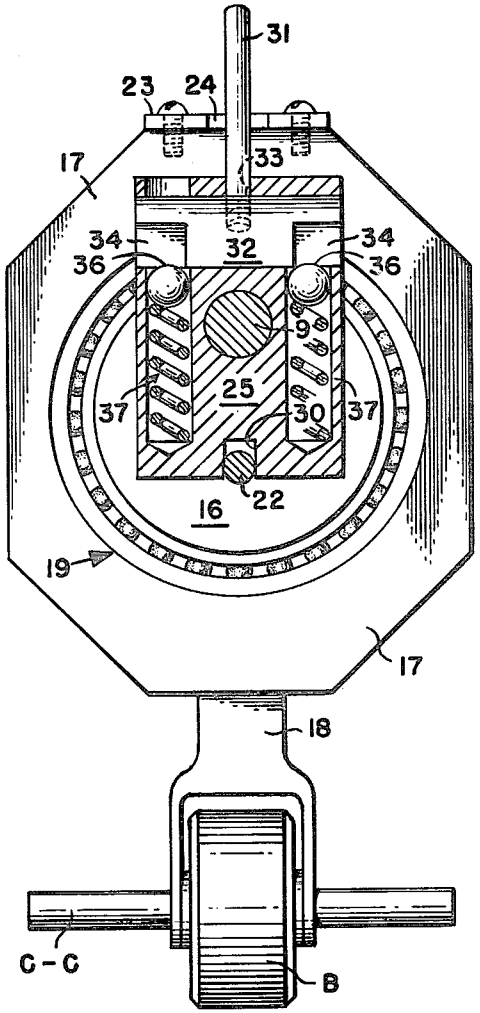
FIG. 2 is a transverse sectional view of a shifting or indexing device as viewed in the direction of arrows 2—2 in FIG. 1.
Figure 1:
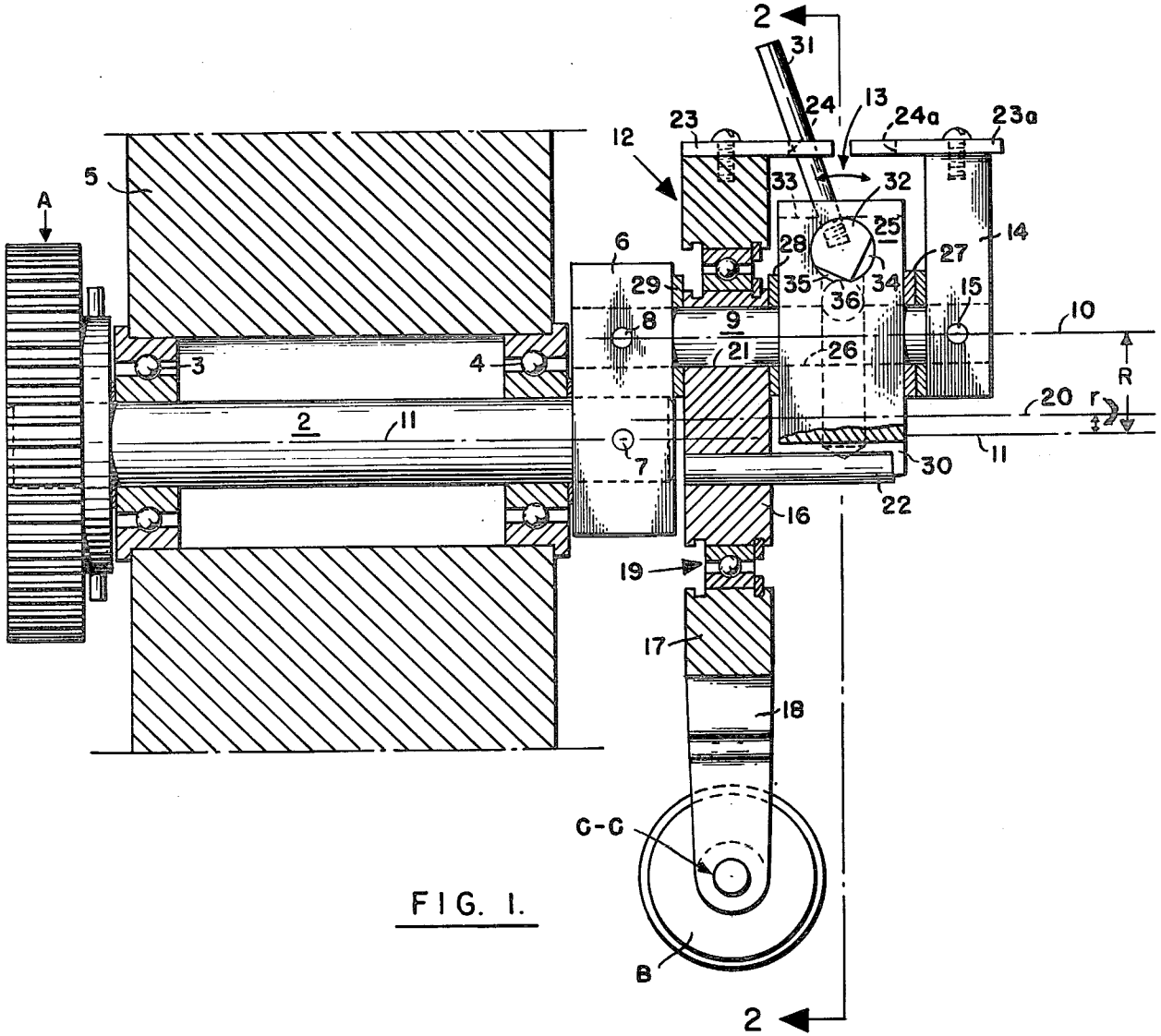
FIG. 1 is a side elevation of the driving mechanism for imparting reciprocating motion to an output member in accordance with the invention, parts thereof being shown in section.

The drive mechanism comprises: eccentric means 12, having a rotable eccentric member 16 rotable within a yoke, strap or connector 17 connected to the output member B, and crank means driven by the drive shaft 2 for driving the eccentric. The crank means comprises a crank arm 6 secured to drive shaft 2, as by a set screw or transverse pin 7, for revolution thereof about the axis of shaft 2. In a suitable bore through the outer end of the crank arm, there is fixedly secured, as by a set screw or transverse pin 8, a crank shaft 9 having its axis 10 parallel to the axis of rotation 11 of the drive shaft 2. The crank shaft is shown in its uppermost position in FIGS. 1, 2 and 3 and has a radius of throw equal to R, as shown in FIGS. 1 and 2, which is the distance between the parallel axes of shafts 2 and 9.

The crank shaft 9 extends through a cylindrical aperture or bore 21 through the eccentric 16, the centerline or axis of the bore being parallel to, but offset radially from, the centerline 20 of the eccentric 16 so that the eccentric is free to rotate relative to the crank shaft 9 which extends through the eccentric and drives it.

A crank arm extension 14 extending radially outwardly from the crankshaft is secured, as by a set screw or transverse pin 15, to the outer end of the crank shaft 9. Stroke-length controlling and selecting means 13 is disposed on crank shaft 9 between the eccentric and the crank arm extension. Instead of providing the crank arm extension at the outer end of crank shaft 9, the extension could be formed as an integral radially outward extension of crank arm 6, but this is not the preferred mode because the eccentric means would have to be mounted further out on crankshaft 9 to accomodate the means 13 between the extension and eccentric, giving rise to greater bending stresses.

The eccentric means comprises the eccentric 16 proper and a yoke, strap, or connector 17 connected, as by a member 18 secured thereto, to the output member B. The eccentric 16 is mounted rotably within the yoke 17, as by an annular ball bearing 19 and, in the position shown in FIGS. 1 and 3, the centerline or axis or rotation of the eccentric 16 is indicated by the line 20 in FIGS. 1 and 2. A pin 22 is fixed in the eccentric and projects laterally from it with its axis parallel to the axis of the crank shaft 9. In the relative positions of the mechanism shown in FIGS. 1, 2, and 3, the axis of pin 22 takes a position below, and in alignment with, the axis of crank shaft 9 and axes 11 and 20 as clearly shown in FIG. 2.

Positioned axially between the eccentric means and the outer crank arm extension 14, there is mounted stroke-length controlling means 13 and means for selectively engaging the controlling means with the yoke 17 and with the crank arm 14 respectively, thereby setting the driving mechanism in one or the other of two different modes or mechanical relationships wherein the output member B is reciprocated through different-length strokes for which the mechanism is designed. As will be apparent from the following description, the embodiment shown incorporates two different output stroke-lengths, one of which is equal to 2R, that is twice the radius of throw of crank arm 6, and the other is markedly shorter.

The stroke-length controlling means 13 comprises a block 25 having a cylindrical bore 26 through which crank shaft 9 extends. The block 25 is supported on crank shaft 9 for rotation thereon. Annular washers may be providd on crank shaft 9 at 27, 28 and 29. A groove 30 extends along the lower portion of block member 25 as viewed in FIGS. 1 to 3 to allow pin 22 to extend into the groove to a greater or less depth as shown in FIG. 1 but without appreciable play of the pin widthwise in slot 30 as shown in FIG. 2.

The means for selectively engaging the controlling means with the yoke 17 and the crank arm extension 14 respectively comprise a selector member 31 and indexing plates or elements 23 and **23*a***.

An indexing plate or member 23 grooved or V-notched as at 24 (see FIG. 3) is fastened to the yoke 17 at the upper ortion thereof as seen in the FIG. 1–3 position. Another indexing plate or member **23*a* having a notch 24*a* is secured to the radially outer portion of crank arm extension 14. The open ends of the notches in the two indexing members are in opposition to each other when the mechanism is in the position shown in FIGS. 1, 2, and 3. This position occurs at the end of each revolution of the drive shaft 2** when the output member B is at the uppermost position in its stroke, whether short or long.

The selector member 31 is secured to a transverse pivotal rod 32, as by screw threads, welding, or press-fitting. The member 31 is swingable back and forth in an arc designated by the curved two-headed arrow line in FIG.1 from the position shown in FIG. 1 where member 31 is engaged in the V-notched indexing plate or member 23 on the yoke 17 to the other position where it is engaged in the opposed indexing plate or member **23*a* V-notched at 24*a* fastened to an outer portion of crank arm extension 14. It should be noted that the opposed position of the notched indexing members occurs once each revolution of drive shaft 2 and the shift from operation in one mode with one set stroke-length to the other mode with a different set length of stroke is done when the notched members 23 and 23*a*** are in opposition.

A groove 33 along the top of member 25 allows the swinging of the index member 31 and the overall cylindrical shape of rod 32 fitting within a transverse cylindrical bore in the member 25 also allows rod 32 to rotate on its axis when member 31 is swung. However, as shown more clearly in FIG. 2, one or both end portions of rod 32 are provided with flat or cut-away portions 34 and 35 which form recessed segments of the rod on opposite sides of a dihedral angle as viewed endwise in FIG. 1. Spring-pressed ball detents 36 in suitable vertical bores 37 below each end of the rod 32 provide quick, snap-action when index member 31 is swung from one extreme position through an intermediate vertical position in crtically unstable equilibrium to the other extreme where the drive mechanism is in the position shown in FIG. 1.

The swinging of selector member 31 from one position to the other may be effected manually or automatically by suitable remote or direct control means. For example, the selector may be swung to provide a predetermined stroke-length by solenoid or other electromagnetic means energized at the reaching of the position shown in FIG. 1; alternatively the activation may be effected by an electric or fluid motor, for example, an air motor, air cylinder or hand crank leverage system. In any event the shift from one stroke-length to another may be effected at any time the mechanism reaches the relative positions shown in FIG. 1. For example, the shift may be made each time that position is attained or it may be made at a definite periodic interval upon the completion of a predetermined number of reciprocation cycles.

The mechanism operates to provide the maximum stroke-length with the member 31 in the plate 23 as shown FIG. 1. In this position, pin 22 in groove 30 prevents block 25 from rotating relative to eccentric 16 but crank shaft 9 is free to rotate in the aligned bores in eccentric 16 and block 25. Upon one revolution of the drive shaft 2, the vertical displacement of yoke 17 and the output member is 2R and the velocity curve approaches simple harmonic motion. The stroke in this position is accordingly a relatively large one. When member 31 is in the notch of the outer index plate **23*a*, the indexing block 25 is engaged with the crank arm extension 14 which is secured to crank shaft 9 by pin 15; in this mode, the arm 14 carries block 25 with it and groove 30 in the block member 25 forces pin 22 to rotate the eccentric 16 about its axis. Upon one revolution of drive shaft 2, the vertical displacement of yoke 17 is 2r (where r is the radial distance from the axis 11 of drive shaft 2 to the centerline of eccentric 16**) and the velocity curve approaches simple harmonic motion. As can be seen, this provides a relatively short stroke compared to that (2R) obtained in the first mode of operation.

Whether the mechanism is operating in the first mode described providing a stroke-length of 2R or in the second mode providing a stroke-length of 2r of reciprocation of output member B, the motion curve of the member B is essentially sinusoidal (i.e., the member B has a modified simple harmonic motion) during its stroke. Stroke selection or shift is made when the piston is in the uppermost position in the pump and does not move during stroke selection. There is no need for the taking of intermediate steps to catch or discard fluid being dispensed by the pump or to recharge a reservoir when fluid make-up is required such as is generally required when the stroke-length is changed substantially with the drive mechanisms of the patents mentioned hereinabove. The time required to make the stroke selection with the mechanism of the present invention is quite short, e.g., from one-tenth second to less than 100 milliseconds.

The mechanisms can be made to provide different combinations of two preset stroke-lengths simply by changing the length of the crank radius or throw R and/or by designing in the drive mechanism an eccentric having its centerline offset from the axis of the drive shaft 1 a different radial distance r.

Changes and variations may be made without departing from the spirit and scope of the invention described herein.

What is claimed is:

1. A dual stroke drive mechanism for reciprocating a piston in a cylinder, comprising eccentric means having a yoke connected to an output member, crank means for driving the eccentric means in two modes to reciprocate the output member through two common paths each having a different stroke length, said crank means having a crank arm, a crank shaft, and a crank arm extension extending radially outward from the crank shaft, stroke-length controlling means arranged to engage the yoke for driving the eccentric means in one mode or to engage the crank arm extension for driving the eccentric means in the other mode having a different stroke length and means for selectively engaging the stroke-length controlling means with the yoke and with the crank arm extension respectively.

2. The drive mechanism according to claim 1 wherein the stroke-length controlling means is axially spaced between the generally radial plane of the eccentric means and that of the crank arm extension.

3. The drive mechanism according to claim 2 wherein the crank arm-extension is fixedly secured to the crankshaft at an outer end thereof axially spaced from the crank arm, the stroke-length controlling means comprises a grooved block supported for rotation on the crank shaft and pin means secured to the eccentric and projecting laterally therefrom into a groove of the block to prevent rotation of the block relative to the eccentric when the block is engaged with the yoke, and to allow rotation of the block relative to the eccentric when the block is engaged with the crank arm extension.

4. The drive mechanism according to claim 3 wherein the axis of the pin means projects laterally from a point in the eccentric such that the pin means axis is parallel to the centerline of the eccentric and the crankshaft axis, said point and the crankshaft axis being spaced different radial distances on opposite sides of the centerline.

5. The dual stroke drive mechanism according to claim 4 wherein the yoke and crank arm extension carry notched plates, and the notched plates come into position with the notches open and opposed to each other at the uppermost ends of the stroke movement of the output member.

6. The drive mechanism according to claim 5 wherein the means for selectively engaging the stroke-length controlling means comprises a member mounted on said block pivotally on an axis transverse to the crank shaft to selectively engage the block with the notch on the yoke and with the notch in the crank arm extension.

7. The drive mechanism according to claim 6 comprising snap-action means for urging the rapid swing of the pivotally mounted member into a notch once the intermediate vertical equilibrium position is passed.

8. A dual stroke pump drive mechanism comprising a drive shaft, means for rotating the shaft on its axis, a crank arm fixed to the drive shaft for rotation about its axis, a crank shaft fixed to the crank arm, eccentric means comprising an eccentric and a yoke within which the eccentric is rotatable, said eccentric means having an eccentric bore through which the crank shaft extends and within which the crank shaft is rotatable, a crank arm extension secured to the other end of the crank shaft, stroke-length controlling means comprising a grooved block mounted rotably on the crank shaft and axially spaced between the eccentric and the crank arm extension, a pin secured in the eccentric at a point thereon on the opposite side from the centerline to that of the axis of the crank shaft, said pin projecting laterally from the eccentric into a groove along the bottom of said block, an output member secured to the yoke, a notched indexing element on the yoke, another notched indexing element on the radially outer portion of the crank arm extension with its notch opening opposed to the notch opening on the yoke when the output member is in the uppermost position in its stroke, and a pivotally mounted selector on the grooved block to be selectively swung into engagement with the notched element on the yoke or on the crank arm extension when their notches are in opposition whereby the drive mechanism is selectively operated to provide either of two stroke lengths for displacement of the output member.

* * * * *